US005971177A

United States Patent [19]

Carter

[11] Patent Number: 5,971,177

[45] Date of Patent: Oct. 26, 1999

[54] PICKUP CRANE

[76] Inventor: E. Dan Carter, P.O. Box 1148, Twin Falls, Id. 83303

[21] Appl. No.: 09/058,311

[22] Filed: Apr. 9, 1998

[51] Int. Cl.[6] ..... B66C 23/44

[52] U.S. Cl. ..... 212/177; 52/726.3; 212/180

[58] Field of Search ..... 212/180, 177; 414/543, 462; 52/116, 726.2, 726.3, 726.4, 726.5

[56] References Cited

U.S. PATENT DOCUMENTS

| | | | |
|---|---|---|---|
| 1,527,323 | 2/1925 | Moore | 52/726.3 |
| 3,836,024 | 9/1974 | Mantino | 212/180 |
| 3,952,893 | 4/1976 | Kolesar | 414/462 |
| 4,806,063 | 2/1989 | York | 212/180 |
| 4,881,864 | 11/1989 | Amato | 414/543 |
| 4,961,605 | 10/1990 | Kisner | 212/180 |
| 5,064,078 | 11/1991 | Van Staveren | 212/180 |
| 5,205,700 | 4/1993 | Lin et al. | 414/540 |
| 5,211,526 | 5/1993 | Robinette | 414/550 |
| 5,540,537 | 7/1996 | Welch | 414/462 |
| 5,662,451 | 9/1997 | Muzzi et al. | 212/180 |
| 5,788,095 | 8/1998 | Watson | 414/543 |

FOREIGN PATENT DOCUMENTS

| | | | |
|---|---|---|---|
| 299823 | 6/1954 | Switzerland | 212/180 |

*Primary Examiner*—Thomas J. Brahan
*Attorney, Agent, or Firm*—Robert L. Shaver; Frank J. Dykas

[57] ABSTRACT

A portable truck crane which mounts in the hitch receiver of a vehicle, and lifts objects. The crane is guyed so that the crane beam is subjected only to compressive forces, not rotational forces. A support leg allows the lifting of heavier loads, and a winch on the crane or the front bumper winch of the vehicle can be used to lift objects. The truck crane assembles without the use of tools, and stores either the seat of a pickup, in the bed of a pickup, in a tool box, or in a suitcase sized storage container.

11 Claims, 6 Drawing Sheets

PICKUP CRANE

BACKGROUND OF THE INVENTION

1. Field of the Invention

The present invention generally relates to vehicle mounted lifting cranes, and more particularly to cranes for mounting in hitch receivers of vehicles.

2. Background Information

It is common for the operator of a vehicle, especially a pickup or heavier duty truck, to need to lift objects. In response to this need, there are numerous devices for lifting objects which operate with a vehicle. Some of these bolt on to the bumper of a pickup or a passenger car, others are mounted in the bed of a pickup, and some mount into the hitch receiver of a vehicle. These lifting devices are usually designed to lift an object and to allow it to be rotated and swung into the bed of a pickup. Cranes such as this are generally fairly heavy, are welded or bolt together with the use of tools, and many of them form a rather permanent installation on the pickup or vehicle. Others which mount in the hitch receiver of a vehicle are not permanent, but may be awkward and time consuming to disassemble and remove, and remain heavy and require the use of tools.

What is needed then is a pickup crane which mounts in a hitch receiver, which is easily assembled and does not require the use of tools to assemble it. Accordingly, it is an object of the invention to provide a pickup crane which mounts in a towing hitch receiver and which assembles without the use of tools. Another object of the invention is to provide a pickup crane which is suitable for lifting objects which are too heavy for a person to lift. A further object of the invention is to provide a pickup crane which utilizes the front bumper winch of a pickup, as a lifting device of a rear mounted pickup crane.

Another object of the invention is to provide a pickup crane which disassembles easily, and without the use of tools, and fits in a storage container small enough to fit behind the seat of a pickup or to fit in the tool box of a pickup.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

The foregoing and other objects and advantages are attained by a dismountable portable crane, designed for mounting to a vehicle. Specifically, the crane is designed to mount to the hitch receiver of a vehicle such as a pickup. The portable crane includes a crane base which can be inserted into a receiver hitch of the vehicle. On the crane base, one or more crane members are attached. If only one crane member is attached, then the crane is configured for lifting objects from a low height. This could be useful for pulling fence posts, manhole covers, or lifting stones for transport around a ranch. Additional crane beam members can be added to the first one to form a crane beam of the length desired for the particular load being lifted. These crane beam members can be assembled and disassembled by hand without the use of tools. When assembled together, they form a non-rotating crane beam for lifting objects from the receiver hitch of a vehicle.

A winch is also associated with the portable crane. This winch can be mounted to a crane beam member, or the winch can be mounted to the front bumper of a vehicle. The winch has a cable which is wound on the winch, and which extends from and retracts within the winch. A hook is on the end of the cable, and is used for lifting objects with the portable crane. A pulley is mounted on the uppermost crane beam member, through which a cable is passed for lifting. The portable crane also has two or more guy lines which are connected to it, and which also connect to the vehicle. These guy lines support and stabilize the crane beam. This portable crane assembles and disassembles without the use of tools, and when disassembled can be stored in a container which fits behind a pickup seat or in a tool box of the vehicle.

The portable crane can also have a base support leg, which is attached to the crane base, and which extends to the ground surface. This base support leg is used to provide added support to the hitch receiver if heavy loads are being lifted with a portable crane. The portable crane can also include a lower pulley through which a cable is passed from the winch on the front bumper of the vehicle. An extension can be added to the crane beam so that the lifting point of the crane is extended backward from the top of the crane beam.

One method by which the crane beam members interfit with each other is by the use of two special types of crane beam members: inner tube members and outer tube members. The outer tube members have an inner diameter or inner measurements which are large enough so that an inner tube member fits inside of an outer tube member. By staggering the joints of the inner tube members and the outer tube members, the crane beam can be built up by stacking an outer tube member on the crane base, an inner tube member inserted next inside the outer tube member, an outer tube member inserted over the protruding end of the inner tube member, and so on, forming a crane beam made of two tubes, with the joints between inner and outer tube members staggered.

Such a portable truck crane is well suited to replace the need for a forklift, other workers to help lift, or specialized lifting machines in many lifting operations, such as lifting tractor wheels, weights for tractors, overhead door springs, electric motors, vehicle bumpers, doors, body panels, engines, dual tire sets, fence posts, stones, and any number of objects. One application for which the portable truck crane is particularly well suited is for lifting game animals for processing. When hunting, a game animal is typically hung by its hind legs on a pole between two trees. When thus suspended, the animal is bled, gutted, skinned, quartered, and placed in game bags. Where the animal is near the vehicle but not near camp or near trees, the portable truck crane provides a convenient way to lift the game animal for these tasks.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawing and description are to be regarded as illustrative in nature, and not as restrictive.

DESCRIPTION OF THE PREFERRED EMBODIMENTS

Figure 1:
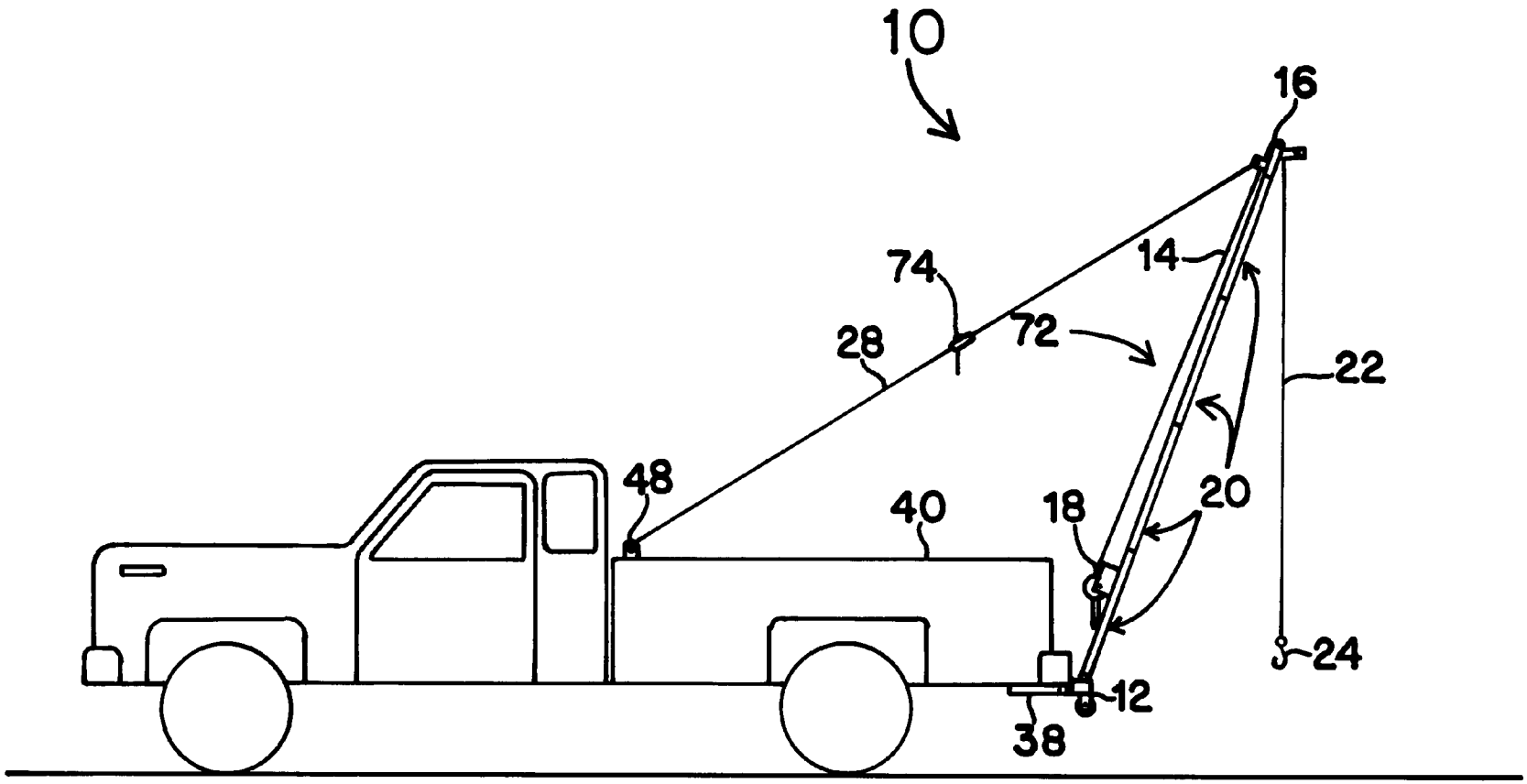
FIG. 1 is a side plan view of the portable truck crane.

The preferred embodiments of the invention are shown in FIGS. 1 through 6. FIG. 1 is a side plan view of the portable truck crane 10. Portable truck crane 10 includes a base member 12, crane beam sections 20, a top member 14, a top pulley 16, a winch 18, with a cable 22, guy lines 28, all attached to the hitch receiver 38 of a vehicle 40.

Figure 2:
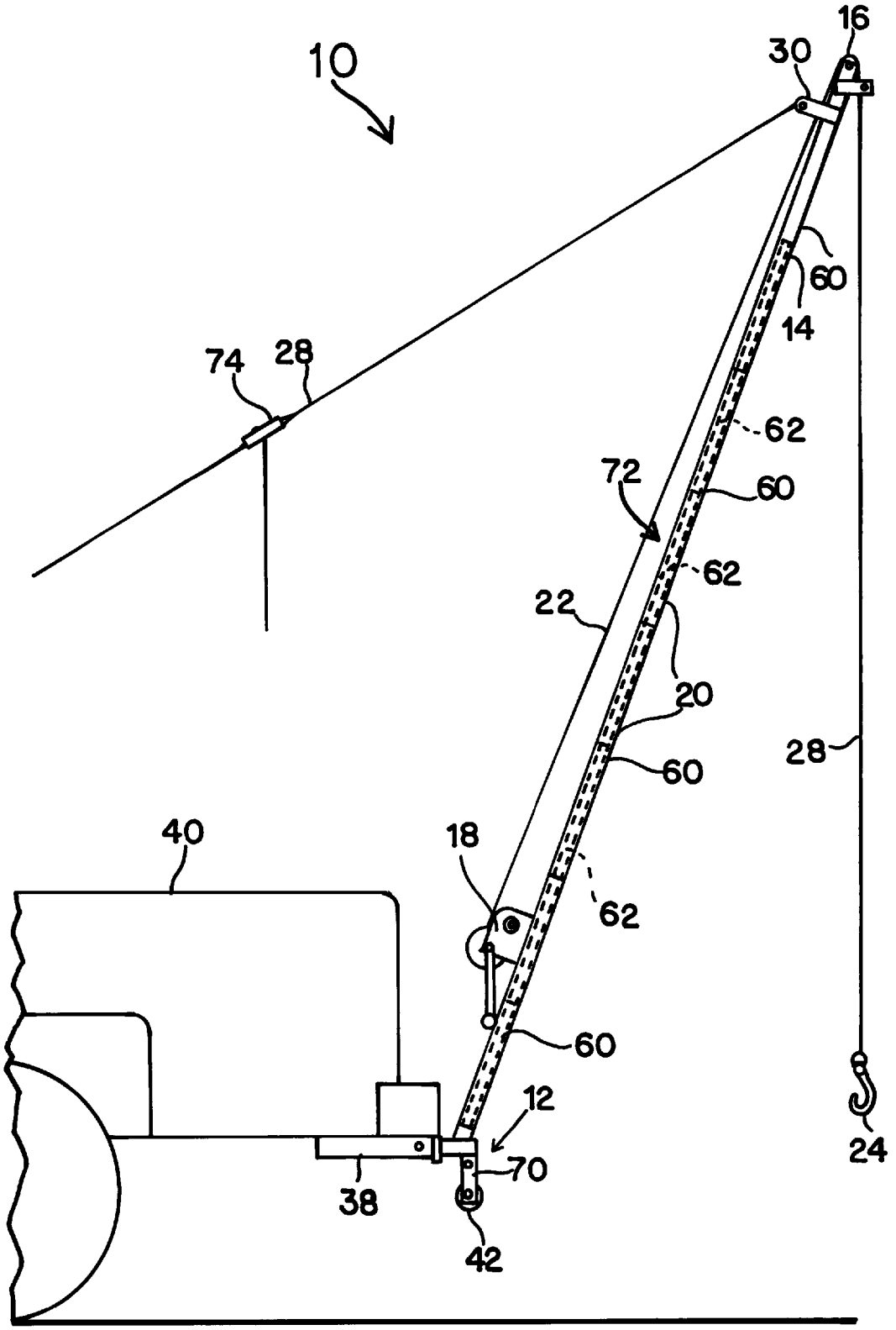
FIG. 2 is a side plan view showing details of the portable truck crane.
Figure 5:
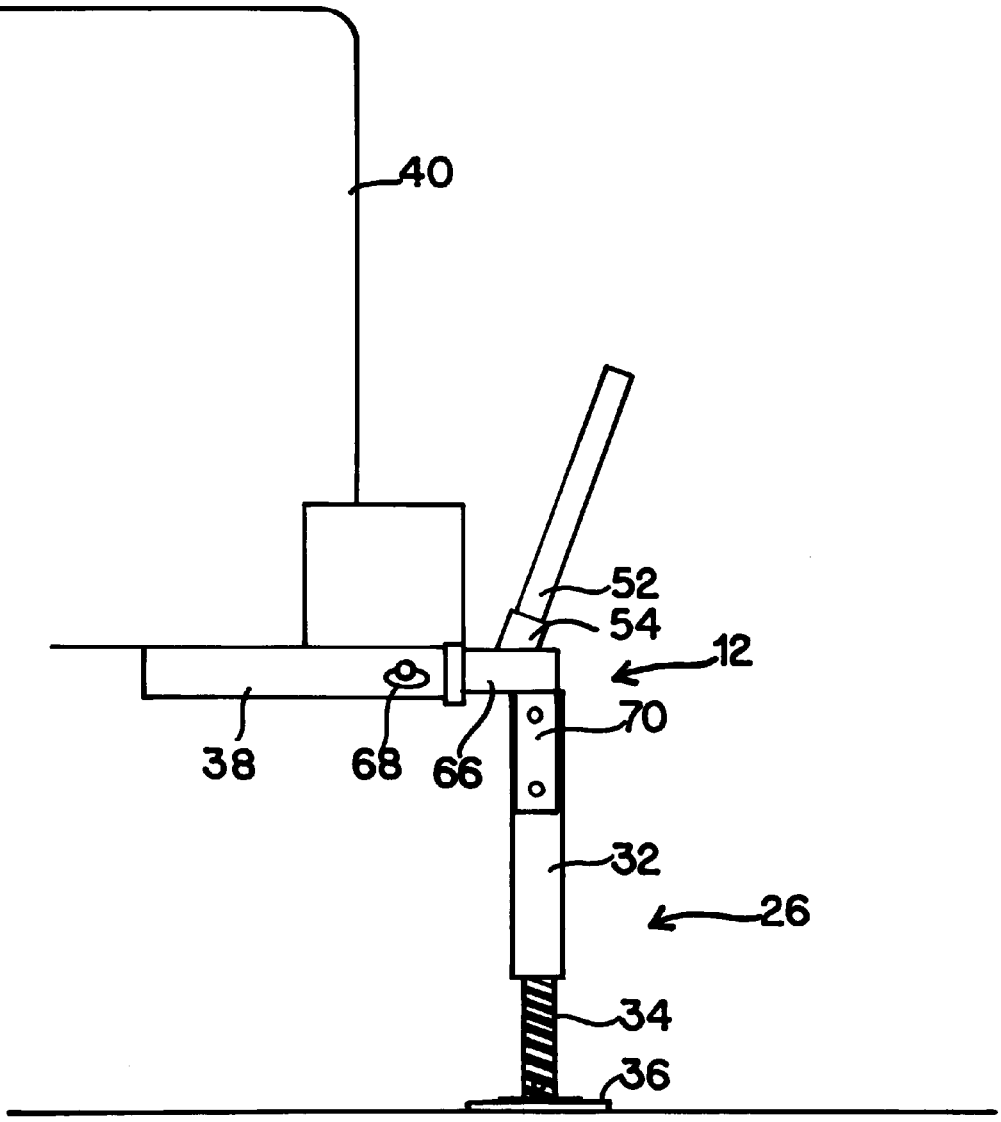
FIG. 5 is a side plan view showing details of the crane base and support leg.

The base member 12 is more closely viewed in FIG. 5. The base member 12 includes an insert tongue 66, which is inserted into the hitch receiver 38 of the vehicle 40. A pin 68 is inserted through corresponding holes in the hitch receiver 38 and the insert tongue 66 to lock the base member 12 in place in the hitch receiver 38. Connected to the insert tongue 66 is a riser 54 from which a riser connector 52 extends at approximately a 69° angle. The riser connector has the same dimensions as the inner tube members 60, and is a 2"×2" square tube. On the underside of insert tongue 66 is mounted a lower bracket 70. To this lower bracket 70, a lower pulley 42 can be mounted, as shown in FIG. 2, or a support leg 26 can be mounted, as shown in FIG. 5. The support leg 26 can be configured to be detachable, or to swing from a horizontal storage position into a vertical support position. The support leg 26 is shown in the support position in FIG. 5. In the support position, a screw 34 with a base plate 36 is extended from a screw tube 32 until it touches the ground and supports weight from the hitch receiver 38 and the base member 12.

Other conventional types of jacks can also be used to extend a leg of the support leg 26. The riser connector 52 is made of 2"×2" square steel tubing in the preferred embodiment. However, other sizes of tubing and other materials can also be used. On the riser connector 52, a crane beam section 20 is inserted, so that the crane beam section 20 surrounds the riser connector 52. The riser connector 52 would typically extend 12" from the riser 54. The crane beam section 20 would typically be 2 feet in length, so that the crane beam section 20 extends beyond the end of the riser connector 52 by 1 foot. In the preferred embodiment of the portable truck crane, a crane beam 72 is assembled by alternately installing the two different sizes of crane beam members, outer tube members and inner tube members. An outer tube 62 is installed on the riser connector 52, followed by an inner tube 60 mounted within the outer tube 62. In this manner, a variable number of crane beam sections 20 can be assembled to form a crane beam 72 of varying heights. In the preferred embodiment, the crane beam includes four outer tubes 62, each of them 2 feet long, for a total length of 8 feet. Other configurations, using a different number of crane beam sections 20, is also possible and within the inventive concept of the portable truck crane 10. The uppermost crane beam section 20 has mounted on it a top pulley 16. This uppermost crane beam section 20 is called the top member 14. In the preferred embodiment, a winch 18 is mounted on the lowermost crane beam section 20. From the winch 18, a cable 22 extends over the top pulley 16 and down to the object being lifted. A hook 24 is preferably attached to the cable 22 to facilitate lifting.

Figure 3:
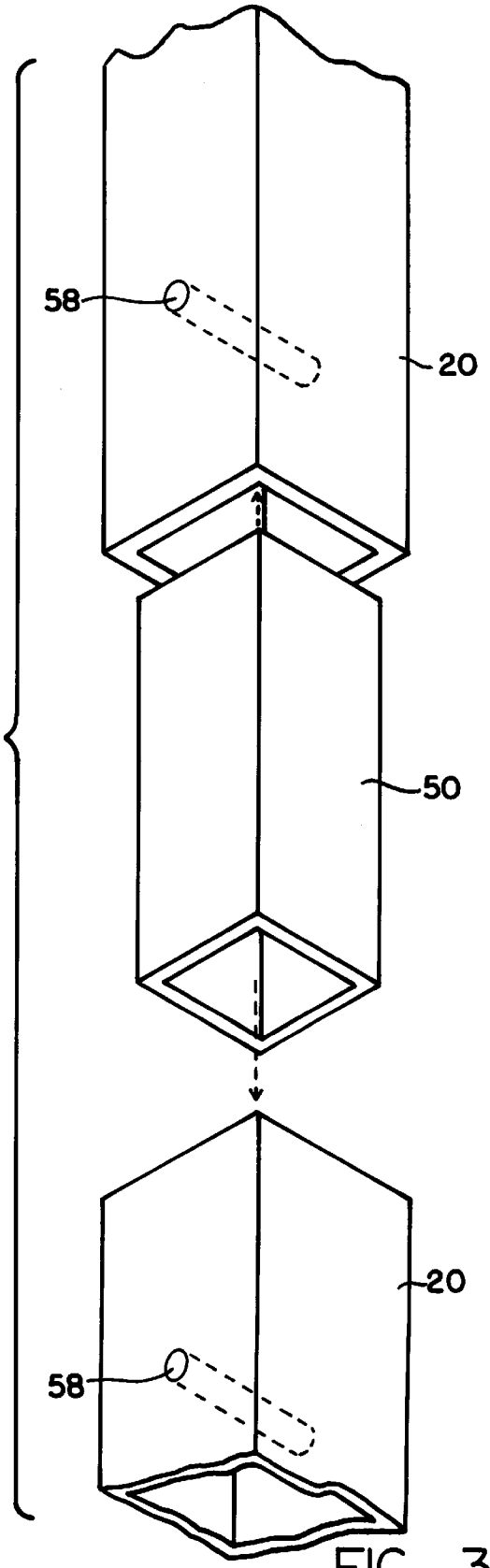
FIG. 3 is a perspective view of an alternate method of assembling the crane beam.

An alternate method of constructing a crane beam 72 is illustrated in FIG. 3. In this method, a stopping pin 58 is mounted in each 2½"×2½" crane beam section 20. A 2"×2" connector 50 is inserted into each crane beam section 20, and another 2½"×2½" crane beam section 20 is inserted over the connector 50. In this way a crane beam 72 is assembled using crane beam sections 20 and connectors 50.

In either mode, guy lines 28, preferably two of them, are attached to a guy loop 30, which is part of the top member 14. The other end of the guy lines 28 is attached to a guy attachment 48 mounted on the vehicle 40. Each guy line 28 has a tensioning buckle 74, which is used to adjust the length of the guy line 28

With the crane beam 72 thus assembled, and the guy lines 28 attached to the vehicle 40 and the crane beam 72, when the winch 18 and its cable 22 lift an object, the force which is placed on the crane 10 is a compressive force. The rotational force which is placed on the top member 14 or the top pulley 16 by the object being lifted is transferred to the vehicle 40 by the guy lines 28. It is for this reason that the crane beam 72 can be constructed of fairly lightweight materials, which are connected by a gravity and friction fit. Since only a compressive force is involved, the crane beam 72 can even be made of such material as a 4×4 wooden beam, with a pulley bracket on top.

Figure 6:
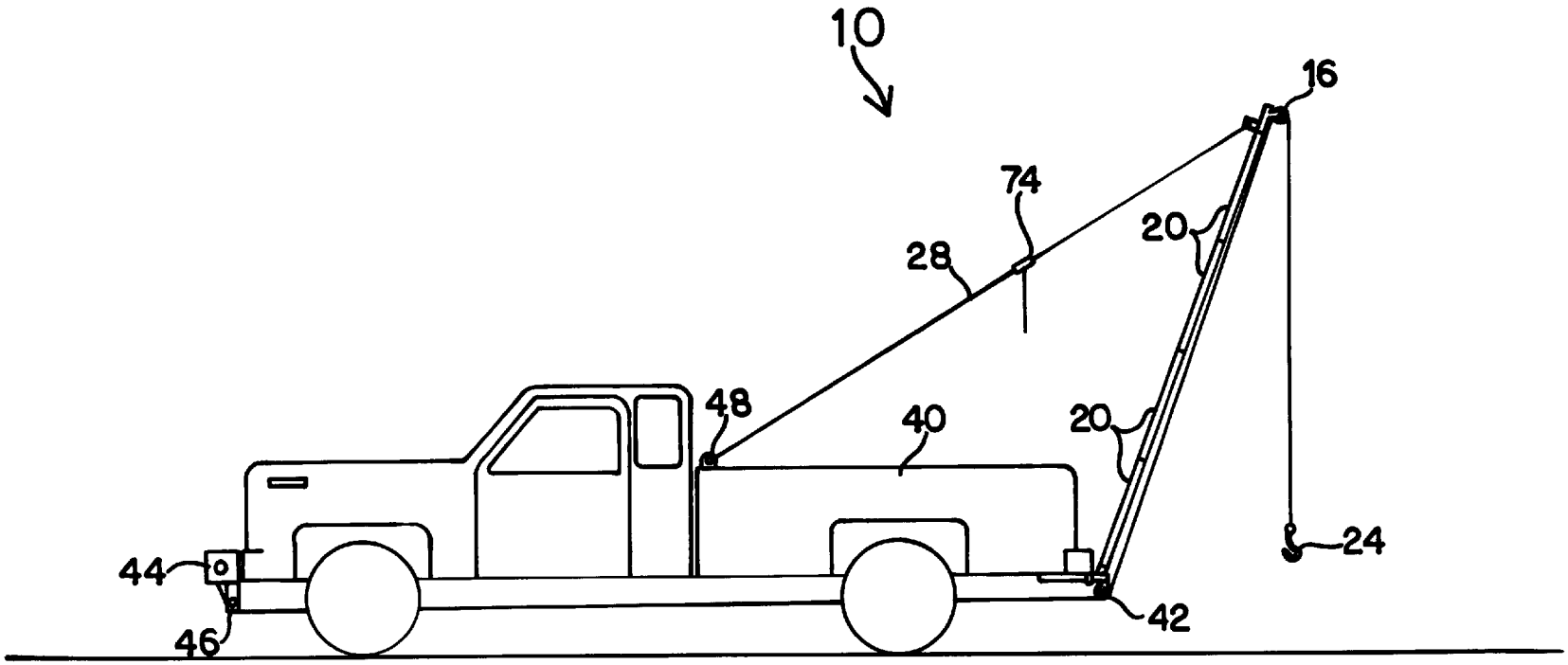
FIG. 6 is a side plan view of the portable truck crane using the front bumper winch to lift.

A second preferred embodiment of the device is shown in FIG. 6. In this device, the winch utilized is the bumper winch 44, which is attached to the front bumper of the vehicle 40. The cable 22 from the bumper winch 44 passes over a front pulley 46, under the vehicle 40, under the lower pulley 42, and over the top pulley 16 which has been moved to an alternate pulley position. In this mode, the bumper winch 44 of the vehicle 40 can be utilized to lift an object at the rear of the vehicle.

Figure 4:
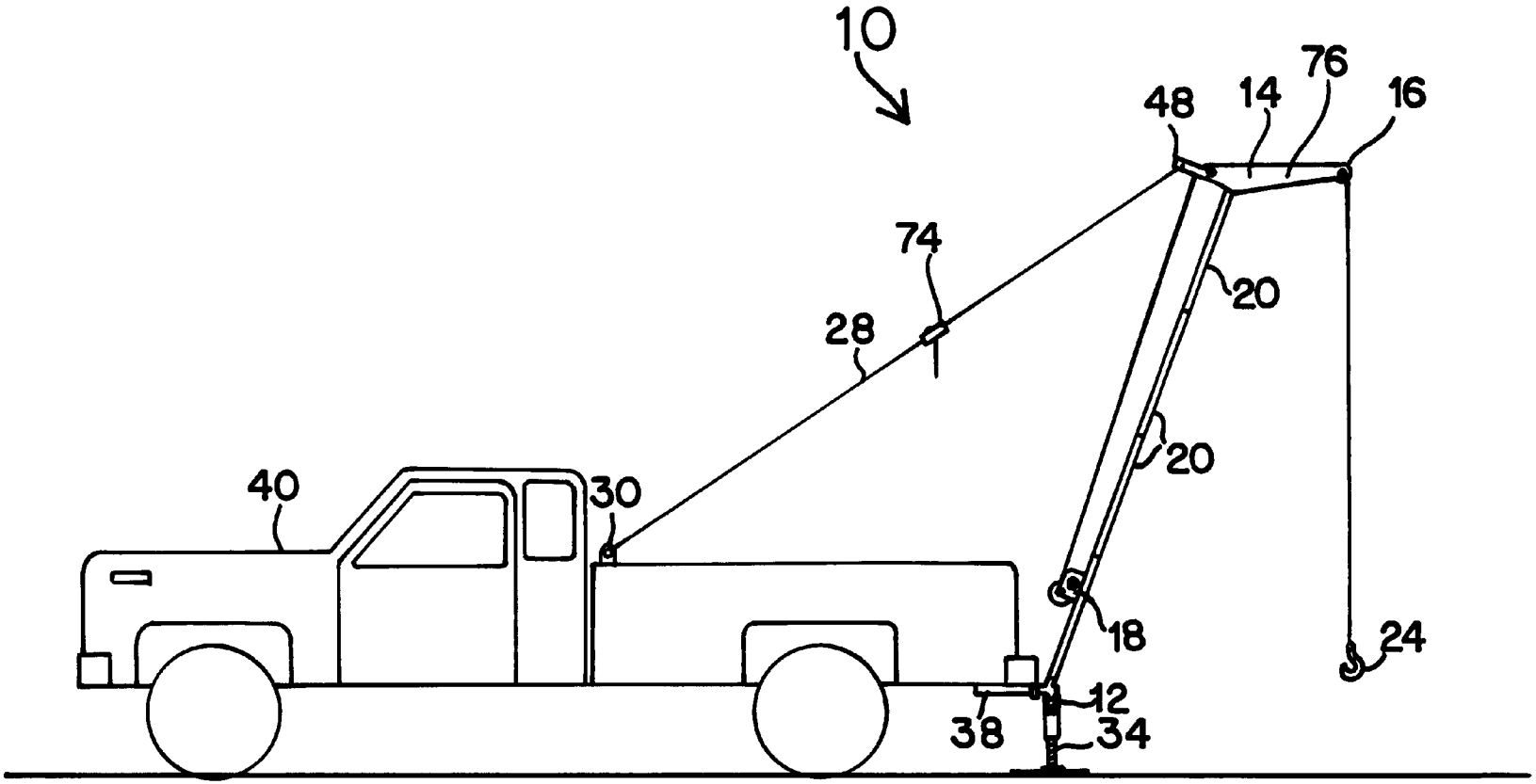
FIG. 4 is a side plan view showing the use of a support leg and extension arm.

The third preferred embodiment of the invention is shown in FIG. 4. In this embodiment, top member 14 includes an extension 76 which moves the lifting point and the top pulley 16 further back away from the vehicle 40. This configuration can be used with the winch 18, or with the bumper winch 44.

In operation, a portable truck crane 10 would be stored in a container, much like a suitcase, which could be stored behind the seat of a pickup truck, in the bed of a pickup truck, or in a large tool box of a pickup truck. To set up the portable truck crane 10, the base member 12 would first be inserted into the hitch receiver 38. A pin 68 would lock the base member 12 in place. Next, an outer tube 62 would be inserted over the riser connector 52 of the base member 12. Next, an inner tube 60 would be inserted into the top half of the outer tube 62, which would be unoccupied. Three more outer tubes 60 and three more inner tubes 62 are thus assembled. The last outer tube 60 is the top member 14, which includes on it a top pulley 16 and guy loops 30. Once the crane beam 72 is thus assembled from crane beam sections 20 including inner tube 62 and outer tube 60, the two guy lines 28 are attached to the guy loop 30 on the top member 14, with tensioning buckles 74 which adjust the length of the guy lines 28 and to the guy attachment 48, and the guy lines 28 are adjusted with a tensioning buckle 74. Next, the cable 22 from the winch 18 is extended over the top pulley 16 and down toward the ground. Alternately, the cable 22 from the bumper winch 44 is extended over the front pulley 46, under the vehicle 40, under the lower pulley 42, and over the top pulley 16. In this configuration, the portable truck crane 10 is ready to lift an object. The hook 24 is attached to the object, or to a harness around the object, and the cable 22 is wound back onto the winch 18 or the bumper winch 44. When the object is lifted to the desired height, the winch 18 is deactivated. In this position, the object being lifted can be worked on at eye level, or it can be transported by driving the vehicle to a new location. If it is planned to lift an object and then drive the vehicle with the object lifted off of the ground, brace arms can be extended between the object being lifted and the vehicle bumper. These are not shown, and would be variable in size, based upon the object to be lifted and transported.

While there is shown and described the present preferred embodiment of the invention, it is to be distinctly understood that this invention is not limited thereto but may be variously embodied to practice within the scope of the following claims.

I claim:

1. A dismountable, portable crane, for mounting to a vehicle, comprising:

a crane base insertable into a receiver hitch of a vehicle, for mounting said portable crane and for connecting to crane beam members;

a crane beam formed of rectangular cross section outer crane beam members with abutting ends surrounding rectangular cross section inner crane beam members with abutting ends, which are nested together with the abutting ends of the outer crane beam members staggered in location from the abutting ends of the inner crane beam members, so joints between adjacent outer crane beam members are positioned midway between joints of adjacent inner crane beam members, which assembles by hand and without tools to form said crane beam, which interfits with said base to form a non-rotatating crane beam for lifting objects;

a winch associated with said portable crane, with a cable wound on and extendable from and retractable within said winch, with a hook on an end of said cable, for lifting objects with said portable crane;

a top pulley mounted to said crane beam, for passage of said cable from said winch; and two or more guy lines connected to said portable crane and to said vehicle, for supporting and stabilizing said crane beam; wherein said portable crane is configured for storage in a container which fits behind a pickup seat, and assembles by hand without use of tools.

2. The portable crane of claim 1 which further comprises a base support leg, which attaches to said base, and extends to a ground surface, for supporting said portable crane when a heavy weight is lifted by said portable crane.

3. The portable crane of claim 1 which further comprises a lower pulley attached to said base, through which said cable extends.

4. The portable crane of claim 3 in which said winch is a front bumper mounted vehicle winch and in which said cable passes under said vehicle from said winch to said lower pulley.

5. The portable crane of claim 1 which further comprises a crane beam extension which attaches to an end of said crane beam, and to which said top pulley is attached.

6. The portable crane of claim 1 in which said winch is attached to a crane beam member.

7. The portable crane of claim 1 in which said guy lines are nylon straps which are connected to said vehicle at one end, and to said portable crane at another.

8. A dismountable, portable crane, for mounting to a vehicle, comprising:

a crane base insertable into a receiver hitch of a vehicle, for mounting said portable crane and for connecting to crane beam members;

a crane beam formed of rectangular cross section outer crane beam members with abutting ends surrounding rectangular cross section inner crane beam members with abutting ends, which are nested together with the abutting ends of the outer crane beam members staggered in location from the abutting ends of the inner crane beam members, so joints between adjacent outer crane beam members are positioned midway between joints of adjacent inner crane beam members, which assembles by hand and without tools to form said crane beam, which interfits with said base to form a non-rotating crane beam for lifting objects;

a winch, mountable on one of said crane beam members or on a front bumper of said vehicle, with a cable wound on and extendable from and retractable within said winch, with a hook on an end of said cable, for lifting objects with said portable crane;

a base support leg, which attaches to said base, and extends to a ground surface, for supporting said portable crane when a heavy weight is lifted by said portable crane;

a top pulley mounted to said crane beam, for passage of said cable from said winch; and two or more guy lines connected to said portable crane and to said vehicle, for supporting and stabilizing said crane beam; wherein said portable crane is configured for storage in a container, and assembles by hand without use of tools.

9. The portable crane of claim 8 which further comprises a lower pulley attached to said base, through which said cable extends.

10. The portable crane of claim 9 in which said winch is a front bumper mounted vehicle winch and in which said cable passes under said vehicle from said winch to said lower pulley.

11. The portable crane of claim 8 which further comprises a crane beam extension which attaches to an end of said crane beam, and to which said top pulley is attached.

* * * * *